United States Patent [19]

Möllenhoff et al.

[11] Patent Number: 4,790,267

[45] Date of Patent: Dec. 13, 1988

[54] ARRANGEMENT FOR BURNING FUELS IN A FLUIDIZED BED WITH AN AUGMENTED SOLIDS CIRCULATION IN A COMBUSTION CHAMBER OF A STEAM GENERATOR

[75] Inventors: Horst Möllenhoff, Mülheim; Heiko Rehwinkel, Kirchhellen; Dirk Bunthoff, Essen, all of Fed. Rep. of Germany

[73] Assignee: Deutsche Babcock Werke Aktiengesellschaft, Oberhausen, Fed. Rep. of Germany

[21] Appl. No.: 136,833

[22] Filed: Dec. 22, 1987

[30] Foreign Application Priority Data

Dec. 23, 1986 [DE] Fed. Rep. of Germany ..... 3644083

[51] Int. Cl.[4] ..... F23C 11/02

[52] U.S. Cl. ..... 122/4 D; 110/204; 110/245; 110/263; 110/347

[58] Field of Search ..... 122/4 D; 110/245, 263, 110/347, 203, 204; 60/39.464; 431/7, 170

[56] References Cited

U.S. PATENT DOCUMENTS

| | | | |
|---|---|---|---|
| 4,442,795 | 4/1984 | Strohmeyer, Jr. | 122/4 D |
| 4,584,949 | 4/1986 | Brannstrom | 122/4 D X |
| 4,640,201 | 2/1987 | Holmes et al. | 122/4 D X |

*Primary Examiner*—Steven E. Warner

*Attorney, Agent, or Firm*—Max Fogiel

[57] ABSTRACT

A steam generator and a method of burning fuels therein. A combustion chamber of gas-tight pipe walls has a fluidized bed. Above the bed is a free space with an incrementally lower solids density that accommodates heat-convection surfaces. Coarse-particle precipitators communicate with the top of the combustion chamber with their solids-extraction outlet communicating with the fluidized bed through a feedback system. The combustion chamber, its heat-convection surfaces, the coarse-particle precipitators, and the feedback system are surrounded by pressurized vessel. The fuel is burned in the fluidized bed under pressure. Densities of 0.5 to 5 kg of solids per kg of flue gas are maintained in the free space (4) above the bed by means of fluidizing rates of 1 to 5 m/sec. The temperature of and load on the fluidized bed are regulated by the amount of solids returned to the bed.

3 Claims, 1 Drawing Sheet

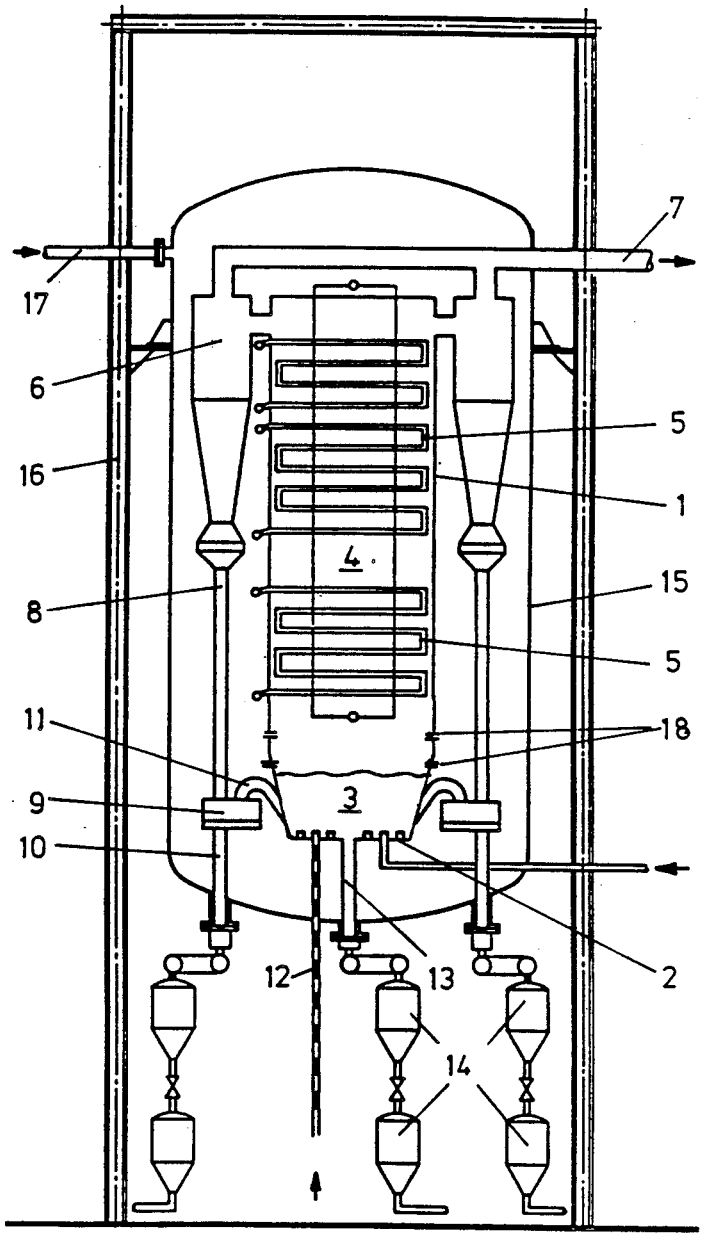
7
17
6
5
16
1
4
15
8
5
11
18
9
3
10
2
12
13
14

ARRANGEMENT FOR BURNING FUELS IN A FLUIDIZED BED WITH AN AUGMENTED SOLIDS CIRCULATION IN A COMBUSTION CHAMBER OF A STEAM GENERATOR

BACKGROUND OF THE INVENTION

The a steam generator and a method of burning fuels in a steam generator of the same type.

A steam generator of this type is outstanding for its brief startup and shutdown times, low pollutant output, good consumption, and potential for burning any type of fuel. It cannot, however, be built above a certain size at a justifiable cost.

That the output of a fluidized-bed combustion chamber can be increased by pressurizing it is known. Known fluidized-bed combustion chambers operate with a strictly stationary fluidized bed and without ash feedback. The combustion chamber of the steam generator and its cyclone is surrounded by a pressure housing. Since the steam generator is one component of a combination gas-and-steam power plant, the flue gases are extracted at processing pressure and at a temperature of 850° C. and supplied to a gas turbine. A cogeneration plant of this type both requires expensive high-temperature pressurized hot-gas filtration and involves hot surfaces inside the fluidized bed and hence exposed to erosion. At an incoming-gas temperature of 850° C., corrosive constituents of the flue gas can damage the gas turbine. Finally, the shipping and storage of bed material makes stoking relatively expensive.

A pressurized steam generator with a circulating fluidized-bed combustion chamber is also known. The combustor, cyclone, and steam-generator convection section in this steam generator are all accommodated in separate pressurized vessels. Processing technology also demands flow-bed coolers to cool the circulating solids.

SUMMARY OF THE INVENTION

The object of the present invention is to improve the aforesaid generic steam generator to the extent that, while its basic properties are retained, its output will be increased enough to make it appropriate not only for new plants but also for retrofiting existing steam-driven power plants.

This object is attained in a generic steam generator by the characteristics recited in the body of claim 1. A method of operating a steam generator of this type is recited in claim 2.

All of the devices needed to operate a steam generator in accordance with the invention can be accommodated within a single pressurized vessel. The steam generator is designed to supply steam for operating a conventional steam turbine. Subjecting the combustion chamber to pressure increases the output of the generic steam generator. The temperature of the flue gas is lowered to the extent that the gas at its existing pressure in the gas turbine can be depressurized to operate an air compressor. No hot-gas filters or devices for exploiting heat loss are necessary. The steam generator can accordingly be employed either with new plants or to replace an existing boiler in the water circulation of an existing steam-driven power plant.

BRIEF DESCRIPTION OF THE DRAWING

One embodiment of the invention will now be described with reference to the drawing, which is a schematic longitudinal section through a steam generator in accordance with the invention.

DESCRIPTION OF THE PREFERRED EMBODIMENTS

The steam generator comprises a combustion chamber 1 surrounded by gas-tight welded pipe walls. The bottom of combustion chamber 1 is conical and is sealed off by a nozzled floor 2 that provides access for combustion air. Above nozzled floor 2 is a fluidized bed 3 with a limited surface. Accommodated in a free space 4 above fluidized bed 3 and inside combustion chamber 1 are heat-convection surfaces 5, which can be interposed in the form of economizers, vaporizers, or superheaters. At the top of combustion chamber 1 are coarse-particle precipitators 6 in the form of unlined cyclones, their gas outlet communicating with a flue-gas line 7 that leads to an unillustrated filter.

The solids-end extraction outlet of coarse-particle precipitators 6 communicates with a feedback system. The feedback system consists of a downpipe 8 that leads to an ash siphon 9. Ash siphon 9 is provided with an extraction line 10 and with a line 11 that leads into fluidized bed 3. In the illustrated embodiment, coal is supplied in the form of a suspension with lime to fluidized bed 3 through a coal line 12. The coal can also be added in another form, lumps for example, to the communicating line 11 between ash siphon 9 and fluidized bed 3. Nozzled floor 2 is provided with an ash outflow 13, Ash outflow 13 communicates, like extraction line 10 with a system of sluices consisting of two bunkers 14.

Combustion chamber 1, the heat-convection surfaces 5 inside it, coarse-particle precipitators 6, and feedback system 8, 9, and 10 are surrounded by a pressurized cylindrical vessel 15 that is designed for example for a pressure of 12 bars. Pressurized vessel 15 is suspended from a scaffold 16. Flue-gas line 7, extraction line 10, and ash outflow 13 extend out of pressurized vessel 15. Opening into pressurized vessel 15 is an airline 17 that supplies air to it at a pressure of 12 bars for example. The air travels through nozzled floor 2 into fluidized bed 3 and, through supplementary nozzles 18 above the bed, into the free space 4 in combustion chamber 1. The air is compressed in an unillustrated compressor before it enters pressurized vessel 15.

The compressor is driven by a gas turbine supplied with flue gas derived from combustion chamber 1 through its downstream filter.

The fuel supplied to combustion chamber 1 burns under pressure along with the air. The air supplied to fluidized bed 3 through nozzled floor 2 also functions as a fluidizing medium. Since the fluidizing rate is maintained at 1 to 5 m/sec, a fluidized bed with a density that is very different from what would occur at the atmospheric pressure prevailing in the free space 4 above the bed is created. The result is a dust charge of 0.5 to 5 kg of solids per kg of flue gas. The hot wall surfaces of combustion chamber 1 and the heat-convection surfaces 5 in the free space 4 inside combustion chamber 1 cool the flue gas deriving from the combustion of the fuel to a temperature of 300° to 500° C. Some of the solids separated out in coarse-particle precipitators 6 are returned to fluidized bed 3 to maintain its temperature at a constant 850° C. for example and to regulate the output. The output is also regulated by varying the amount of air and fuel employed.

Although the present invention has been described with reference to one or more embodiments by way of example, it is in no way to be considered confined to them, and various alternatives will be evident to one of skill in the art that do not exceed its scope.

We claim:

1. A method of burning fuels in a fluidized bed with an augmented solids circulation in a combustion chamber of a steam generator, comprising the steps: cooling flue gases to 300° C. to 500° C. and cleaning preliminarily said flue gases in coarse-particle precipitators communicating with said combustion chamber at a top portion of said combustion chamber; returning at least a part of resulting solids to the fluidized bed; burning fuel in the fluidized bed under pressure; maintaining densities of 0.5 to 5 kg of solids per kg of flue gas in a free space above said fluidized bed by fluidizing rate of 1 to 5 m/sec; and regulating the temperature of said bed and load on said bed by amount of solids returned to the fluidized bed.

2. A method of burning fuels in a fluidized bed with an augmented solids circulation in a combustion chamber of a steam generator, comprising the steps: cooling flue gases to 300° C. to 500° C. and cleaning preliminarily said flue gases in coarse-particle precipitators communicating with said combustion chamber at a top portion of said combustion chamber; returning at least a part of resulting solids to the fluidized bed; burning fuel in the fluidized bed under pressure; maintaining densities of 0.5 to 5 kg of solids per kg of flue gas in a free space above said fluidized bed by fluidizing rates of 1 to 5 m/sec; regulating the temperature of said bed and load on said bed by amount of solids returned to the fluidized bed; providing said precipitators with solids-extraction outlets communicating with said fluidized bed through feedback means, said free space having heat-convection surfaces; and surrounding said combustion chamber, said heat-convection surfaces, said precipitators, and said feedback means by a pressurized vessel.

3. An arrangement for burning fuels in a fluidized bed with an augmented solids circulation in a combustion chamber of a steam generator, comprising: means for cooling flue gases to 300° C. to 500° C. and means for cleaning preliminarily said flue gases in coarse-particle precipitators communicating with said combustion chamber at a top portion of said combustion chamber; returning at least a part of resulting solids to the fluidized bed; means for burning fuel in the fluidized bed under pressure; means for maintaining densities of 0.5 to 5 kg of solids per kg of flue gas in a free space above said fluidized bed by fluidizing rates of 1 to 5 m/sec; and means for regulating the temperature of said bed and load on said bed by amount of solids returned to the fluidized bed.

* * * * *